United States Patent [19]

Larsen et al.

[11] 3,958,316

[45] May 25, 1976

[54] LIQUID PHASE-SINTERED MOLYBDENUM BASE ALLOYS HAVING ADDITIVES AND SHAPING MEMBERS MADE THEREFROM

[75] Inventors: Earl I. Larsen, Indianapolis, Ind.; Richard H. Krock, Weston, Mass.

[73] Assignee: P. R. Mallory & Co., Inc., Indianapolis, Ind.

[22] Filed: Nov. 29, 1973

[21] Appl. No.: 420,107

Related U.S. Application Data

[62] Division of Ser. No. 109,121, Jan. 25, 1971, abandoned.

[52] U.S. Cl. ..... 29/182; 249/135

[51] Int. Cl.[2] ..... C22C 1/04

[58] Field of Search ..... 29/182; 75/176; 249/135

[56] References Cited

UNITED STATES PATENTS

| | | | |
|---|---|---|---|
| 3,656,731 | 4/1972 | Larsen | 29/182 UX |
| 3,676,083 | 7/1972 | Cheney et al. | 29/182 |
| 3,720,990 | 3/1973 | Larsen | 29/182 |
| 3,770,392 | 11/1973 | Amra | 29/182 |

*Primary Examiner*—Benjamin R. Padgett
*Assistant Examiner*—R. E. Schafer
*Attorney, Agent, or Firm*—Hoffman, Meyer & Hanson

[57] ABSTRACT

Molybdenum alloys containing at least two metallic element components which form a molten alloy which dissolves appreciable Mo during liquid phase sintering may contain additives selected from Co, Mn, Cr, Ru, Zr, Ti, Hf, Re, refractory metals, and metalloids to obtain desired properties for certain applications. Many of these additives are particularly effective in shaping members.

17 Claims, 6 Drawing Figures

LIQUID PHASE-SINTERED MOLYBDENUM BASE ALLOYS HAVING ADDITIVES AND SHAPING MEMBERS MADE THEREFROM

This is a division of application Ser. No. 109,121, filed Jan. 25, 1971, now abandoned.

In application Ser. Nos. 855,712 now abandoned and 855,701 now U.S. Pat. No. 3,656,731, filed Sept. 5, 1969 and assigned to the same assignee as the present application, tungsten base alloys containing respectively iron-nickel and iron-nickel-molybdenum were described which have advantages over currently used tool steel materials for die casting dies and their components for the casting of high temperature molten materials such as copper, brasses and bronzes.

While the foregoing tungsten base materials perform extremely well, they have certain undesirable economic characteristics. Tungsten is quite expensive on a weight basis. Its density of 19.3 g/cc is one of the highest of all elements. Therefore, its volume per unit weight is lower than most other metallic elements. Consequently, more weight is required to make a given die or tool than if it were fabricated from most other metals.

Molybdenum has a density of 10.2 g/cc which is approximately 52.8% that of tungsten. In other words, almost twice the volume of molybdenum can be had for the same weight. Since molybdenum is normally considerably less costly than tungsten, the economic advantages of molybdenum over that of tungsten are further increased. Furthermore, molybdenum is a refractory metal and has a high melting point; both of which make it attractive as a potential material for shaping members such as casting dies and other mold components.

It is known that wrought molybdenum and more particularly molybdenum with minor (less than 1 percent) percentages of such elements as titanium and zirconium perform extremely well as die casting dies, core rods and other parts of molds in the die casting of high temperature alloys such as yellow brass.

At the present, such molybdenum alloys are generally fabricated by first vacuum melting to form an ingot. The ingot is then hot forged or otherwise worked to form a slab, block, or other shape of suitable size from which a die, core rod, or other mold segment can be machined.

The foregoing and/or other working operations may cause the finished die or mold segment to have a preferred grain orientation. Thus, the ductility of the die or mold segment is adversely affected in planes perpendicular to the elongated grain structure. Failure of the aforementioned molybdenum base alloys by cracking and spalling along these planes results.

The melting, casting, and subsequent hot forging or working increases the cost of the final article a great deal. Thus, the fundamental economics of lower density, greater volume per unit of weight, and lower cost of molybdenum are often offset, if not completely eliminated, by these expensive procedures.

It is therefore an object of the present invention to develop additional molybdenum base alloys or composites for all types of applications and especially those for shaping members including dies, core rods, or other mold segments for the high temperature forming of metals such as the die casting of non-ferrous materials such as copper, brasses, and bronzes, and iron base materials such as steel, cast iron, and other metals and alloys.

It is another object of the present invention to utilize the economic advantages of molybdenum resulting from its relatively low density, volume per unit of weight, and relatively low cost to form articles which will have long life and be reasonably inexpensive.

It is another object of the present invention to use powder metallurgy techniques to form molybdenum alloys or composites having the good mechanical properties particularly at elevated temperature.

Another object is to provide molybdenum base alloys for shaping members including dies, core rods, mold segments, etc.

Another objective of the present invention is to utilize liquid phase sintering in the fabrication of the molybdenum base alloys or composites made from metal powders.

Another objective of this invention is to provide a molybdenum base alloy or composite free from any preferred grain orientation so that it will have essentially the same mechanical properties in all planes.

It is another object of the present invention to reduce the formation of intermetallic compounds in liquid phase sintered molybdenum alloys for some applications.

It is another object of the present invention to improve ductility in liquid phase sintered molybdenum alloys for some applications.

It is another object of the present invention to increase oxidation resistance in liquid phase sintered molybdenum alloys for some applications.

It is another object of the present invention to reduce the effort of interstitial impurities in liquid phase sintered molybdenum alloys for some applications.

It is another object of the present invention to provide solid solution strengthening in liquid phase sintered molybdenum alloys for some applications.

Other objects will be apparent from the following description.

Figure 1:
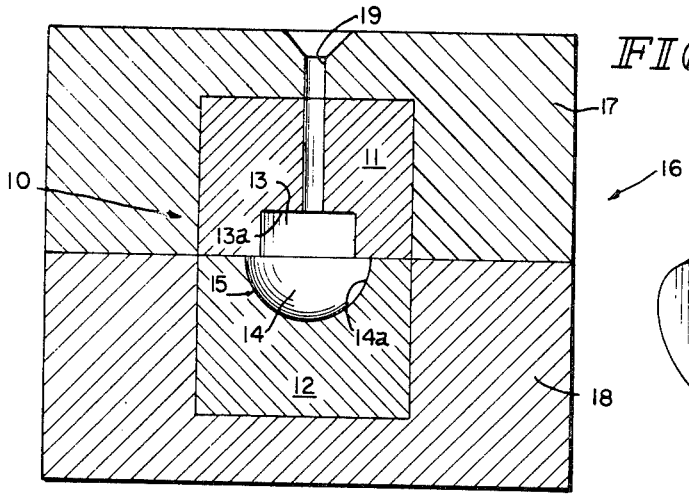
FIGS. 1 and 2 are cross sections of typical die casting apparatus.

The alloys or composites of the present invention are composed of at least metallic elements with molybdenum being the base or predominant element. To be effective as an alloy or composite for use in die casting dies, core rods, or other components of dies or molds used to shape or from high temperature molten metals, the molybdenum content of the alloy should be at least about 80% by weight.

The other two or more elements from an alloy which when molten will dissolve an appreciable quantity of molybdenum to bring about liquid phase sintering.

In Larsen, application Ser. No. 790,861, filed Jan. 18, 1969 assigned to the same assignee as the present application molybdenum base alloys which may be liquid phase sintered, of which one particularly advantageous application is in the formation of shaping members such as dies, core pins, etc. for die casting. These compositions are listed in Table I.

Table I

| | Mo Content | Alloy Content | | Alloy Composition |
|---|---|---|---|---|
| 1. | 80%-99% Mo + | 20%-1% | 2%-8% | B + Bal Essentially Co |
| 2. | 80%-99% Mo + | 20%-1% | 2%-10% | B + Bal Essentially Fe |
| 3. | 80%-99% Mo + | 20%-1% | 2%-20% | B + Bal Essentially Ni |
| 4. | 80%-99% Mo + | 20%-1% | 1%-20% | B + Bal Essentially N6 and/or Ta |
| 5. | 80%-99% Mo + | 20%-1% | 1%-20% | B + Bal Essentially Cr |
| 6. | 80%-99% Mo + | 20%-1% | 1%-10% | B + Bal Essentially V |
| 7. | 80%-99% Mo + | 20%-1% | 10%-70% | Mn + Bal Essentially Ni |
| 8. | 80%-99% Mo + | 20%-1% | 30%-90% | Mn + Bal Essentially Fe |
| 9. | 80%-99% Mo + | 20%-1% | 20%-70% | Mn + Bal Essentially Cu |
| 10. | 80%-99% Mo + | 20%-1% | 30%-90% | Mn + Bal Essentially Ti |
| 11. | 80%-99% Mo + | 20%-1% | 5%-80% | Mn + Bal Essentially Zr |
| 12. | 80%-99% Mo + | 20%-1% | 30%-90% | Mn + Bal Essentially U |
| 13. | 80%-99% Mo + | 20%-1% | 20%-95% | Mn + Bal Essentially Si |
| 14. | 80%-99% Mo + | 20%-1% | 20%-80% | Mn + Bal Essentially Co |
| 15. | 80%-99% Mo + | 20%-1% | 20%-80% | V + Bal Essentially Fe |
| 16. | 80%-99% Mo + | 20%-1% | 20%-60% | V + Bal Essentially Ni |
| 17. | 80%-99% Mo + | 20%-1% | 10%-70% | V + Bal Essentially Co |
| 18. | 80%-99% Mo + | 20%-1% | 5%-30% | V + Bal Essentially Mn |
| 19. | 80%-99% Mo + | 20%-1% | 5%-50% | Si + Bal Essentially Ni |
| 20. | 80%-99% Mo + | 20%-1% | 5%-65% | Si + Bal Essentially Fe |
| 21. | 80%-99% Mo + | 20%-1% | 5%-70% | Si + Bal Essentially Co |
| 22. | 80%-99% Mo + | 20%-1% | 5%-30% | Si + Bal Essentially Cu |
| 23. | 80%-99% Mo + | 20%-1% | 5%-60% | Si + Bal Essentially V |

The following are the weight percentage compositions of additional alloys which will bring about liquid phase sintering of the alloy or composite. The total weight of these combinations will be present in the molybdenum base in amounts up to about 20 percent, with molybdenum making up essentially the balance. The compositions are disclosed in Krock application Ser. No. 109,377, filed Jan. 25, 1971, now abandoned, assigned to the same assignee as the present application.

1. The molybdenum content, and conversely the amount of dissolving alloy present;
2. The composition of the dissolving alloy; and
3. The liquid phase sintering temperature.

To attempt to place actual numbers on the three foregoing variables is extremely difficult. For example, the amount of molybdenum dissolved in a ternary composite containing 99 percent molybdenum would be entirely different than one containing 80 percent molybdenum.

Table II

| | Molybdenum Content | Alloy Content | Alloy Composition | |
|---|---|---|---|---|
| 1. | 80%-99% molybdenum + | 20%-1% | 0.5%-10% nickel | + bal essentially cobalt |
| 2. | 80%-99% molybdenum + | 20%-1% | 0.5%-10% nickel | + bal essentially iron |
| 3. | 80%-99% molybdenum + | 20%-1% | 0.5%-10% nickel | + bal essentially chromium |
| 4. | 80%-99% molybdenum + | 20%-1% | 0.5%-10% nickel | + bal essentially copper |
| 5. | 80%-99% molybdenum + | 20%-1% | 20%-80% vanadium | + bal essentially chromium |
| 6. | 80%-99% molybdenum + | 20%-1% | 20%-30% iron | + bal essentially cobalt |

In the Tables I and II, the percentages for the two elements other than molybdenum total 100 percent in each instance. In example 1 of Table II the compositions might be:

80% Mo — 20% (0.5% nickel — 99.5% cobalt)
80% Mo — 20% (10% nickel — 90% cobalt)
90% Mo — 10% (70% nickel — 30% copper)
90% Mo — 10% (90% nickel — 10% copper)

The other compositions shown in Tables I and II may vary in the same way.

The amount of molybdenum which will be dissolved by the additional metallic elements which form the dissolving alloy is dependent on several factors:

In view of this, it is estimated that the amount of molybdenum dissolved in a composite containing 99 percent molybdenum would be on the order of 0.5 to 1.5 percent, and that of an 80 percent molybdenum composite might range from 20 percent to about 30 percent at liquid phase sintering temperature.

In accordance with present invention additional alloying elements may also be added to the alloys for particular applications including precipitation hardening elements such as Al, Ti, Cu, up to 5 percent total, fully hardened 10 percent over as sintered; dispersion hardening elements such as C, N and Si up to 15–20 percent over as sintered.

Furthermore, the following additives may be used in connection in the liquid phase sintered systems indicated above in order to obtain the result indicated.

TABLE III

| Item No. | Additive | Amount | Result | Improvement over as sintered |
|---|---|---|---|---|
| 1 | Co | up to 5% | Retards formation of Mo | |

TABLE III-continued

| Item No. | Additive | Amount | Result | Improvement over as sintered |
|---|---|---|---|---|
| | | | intermetallics such $MoNi_4$ | |
| 2. | Mn | up to 5% | Improves ductility, partitorsion ductility | at least 10% |
| 3. | Ru | up to 1% | Retards formation of Mo intermetallics | |
| 4. | Cr | up to 5% | Retards formation of Mo intermetallics and improves oxidation resistance at elevated temperature | at least 20% |
| 5. | Ti/Zr/Hf | up to 5% total | Prevent intermetallics and removes interstitials and improves ductility to below 5 ppm | increase 20–25% |
| 6. | Re | up to 10% | Retards formation of Mo intermetallics and improves oxidation resistance at elevated temperaturs<br>Improves ductility | at least 20%<br>20–25% |
| 7. | Refractory metals (W,Ta,Nb) | up to 5% total | Solid Solution strengthening of Mo particles and retards formation of Mo intermetallics | 5–10% |
| 8. | Metalloid Si/B | up to 2% total | Retards formation of Mo intermetallics and are compound formers in dispersion strengthening | 15–20% |

The shapes to be formed from the foregoing alloys may be made in one of the following ways:

An alloy having a composition in accordance with the present invention may be pressed to a given shape, machined to the particular shape desired and then sintered to form a composite alloy.

Alternatively, the alloy may be first pressed and then sintered, in which case machining is carried out at the end of the operation. Closer tolerances may be obtained according to this procedure.

In the pressing operation, any of the well known binders may be used, for example zinc stearate and/or paraffin. Alternatively, isostatic pressing may be carried out in which no binder is needed. For example, the particles to be pressed together are placed in a plastic bag and liquid pressures of at least about 10,000 psi are applied to the particles through the bag.

The metal powders may be pressed either as alloys containing the metals of the present invention or as elemental powders of the metals of the present invention or as mixtures of both.

The sintering temperature to be used in processing the alloy of the present invention is from about 1000° to about 1600°C. Pre-sinter operation may be utilized in a temperature range of about 300° to 1000°C.

In both the pre-sintering and the sintering operation an atmosphere which excludes oxygen must be maintained. Such an atmosphere may be maintained by means of a vacuum or by means of an inert gas such as nitrogen, argon, helium, etc. Additionally, an atmosphere of dissociated ammonia may be used to maintain the inert atmosphere.

In accordance with another embodiment of the present invention the liquid phase sinter compositions given in Tables I and II may be liquid phase sintered at temperatures between about 1000° to 1500°C, with or without the addition of one or more of the elements given in Table III. The liquid phase sintered alloys are then cooled to room temperature at a rate sufficient to substantially avoid or reduce the formation of brittle intermetallic compounds such as $MoNi_4$. The cooling rate will vary with the particular alloy composition and particular sintering temperature utilized, but will generally be at a rate of at least 500°C per hour but below about 5000°C per hour to avoid cracking. Preferably the cooling rate is between 3000° to 3500°C per hour.

In using the alloys of the present invention as shaping members, dies, core rods and other mold parts, in the casting of copper and copper base alloys, such as brasses and bronzes, temperatures in the range of 500° to 1100°C will be encountered. The room and elevated temperature properties render the alloys of the present invention useful in a wide variety of structural applications, particularly where elevated temperatures are encountered such as aircraft and space industries.

The alloys of the present invention can also be used in the casting of other high melting point metals including iron, nickel and cobalt base alloys, as well as in the casting of lower temperature metals including aluminum, zinc and magnesium base alloys.

In accordance with the present invention a shaping member such as a die, mold, core or other metal shaping member is utilized having a molding surface comprising an alloy previously described. For example, the shaping members may comprise one or more die blocks defining a portion of a die cavity, as well as cores, core pins and other metal shaping members commonly associated with ferrous and non-ferrous casting, particularly die casting. The conduit or conduits, or other means to conduct molten metal to the casting cavity may also utilize surfaces made of the previously described alloys, if desired.

Referring now to FIG. 1, an exemplary die casting die or mold 10 in the main comprises at least two blocks 11 and 12 each having a cavity 13 and 14 the blocks being positioned adjacent each other to form a continuous die cavity 15 for forming a metal part. As shown, the casting die is held within a block housing 16 composed of two sections 17 and 18. Molten metal from which the part is to be formed, is fed to the cavity 15, under pressure, by way of conduit 19. The shape of cavity 15 is determined by molding surfaces 13*a* and 14*a*. The shape of the cavity as shown in FIG. 1 is by way of illustration only, the particular shape being case being dependent upon the shape of the part desired.

An important feature of the present invention lies in the material used to fabricate the shaping members such as blocks 11 and 12 which define the surfaces 13*a* and 14*a*. A molybdenum base alloy containing at least one of the foregoing additives is used to give dies and other shaping members longer life. High melting point metals and alloys such as cast iron, steel, copper, bronzes and brasses or other non-ferrous metals such as aluminum, aluminum alloys, zinc, zinc alloys, magnesium and magnesium alloys may be molded. It is within the scope of the invention to form such surfaces from molybdenum alloy coating upon the die blocks, cores, core pins, or other shaping members.

Figure 2:
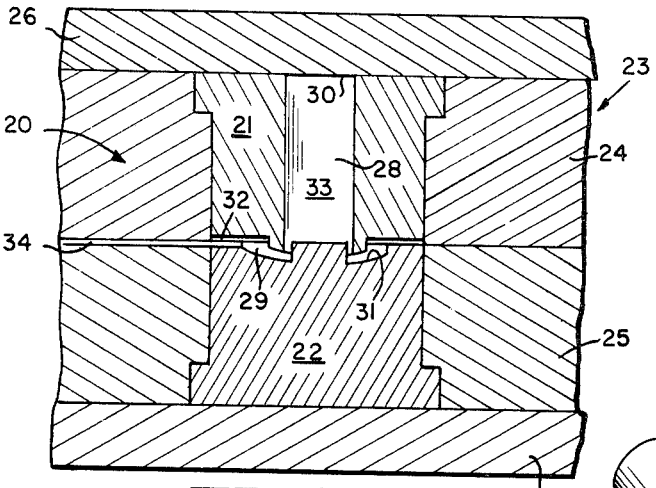

With particular reference to FIG. 2, another embodiment of the present invention is described. In FIG. 2, a die casting die or mold 20 is formed from two split sections or blocks 21 and 22, the blocks being fabricated from the molybdenum base alloy of the present invention. The die is held within a block housing 23 that is principally made up to two sections 24 and 25 and backing plates 26 and 27.

Each section of the die contains a cavity 28 and 29 each having a mold surface 30 and 31, the cavities being machined into the blocks. Cavities 28 and 29 together with the space 32 formed by the spaced relationship of the blocks 21 and 22 form the continuous die cavity 33. The particular part being formed by the casting die in this instance comprises a faucet nut having approximately ⅝ inch I.D. a 1 inch O.D. and a length of ¾ inch. The molten metal used to form the article is fed to the cavity through conduit 34.

After forming blocks 21 and 22 with their cavities, the blocks were heat treated to increase their ductility such that an elongation of about 15 percent was achieved.

FIGS. 3 through 6 depict various other high temperature tooling components used in the die casting and plastic injection molding industries wherein the molybdenum alloy of the present invention has been found to be remarkably superior to prior art materials used in fabricating the components. It should be understood, however, that the components shown are merely illustrative and not exhaustive in scope.

Figure 3:
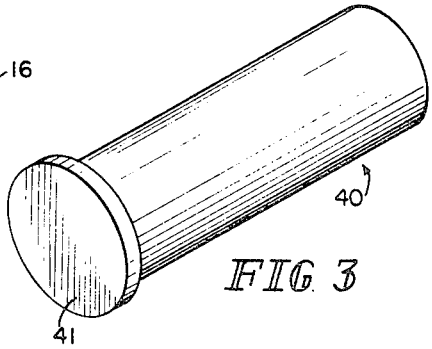
FIGS. 3–6 are perspective views of various high temperature tooling components useful in die casting and plastic injection molding.
Figure 4:
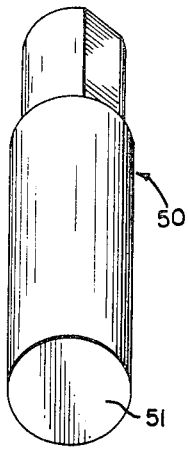
Figure 5:
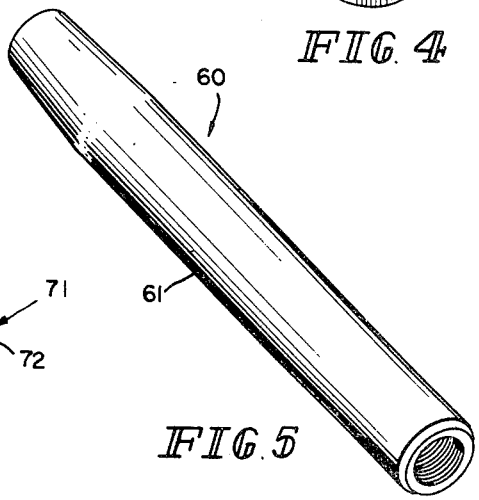
Figure 6:
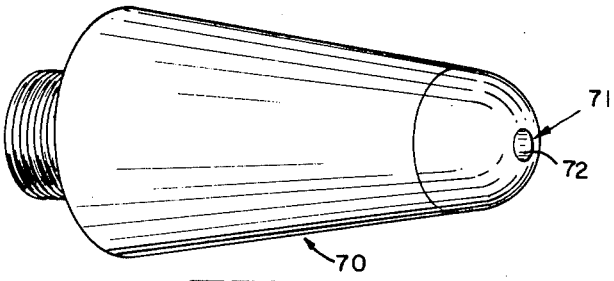

In FIG. 3 there is shown a sprue pin 40 whose working surface 41 normally forms a part of the die cavity and which is used to knock out the formed part from the die cavity. In FIG. 4 there is shown a plunger tip 50 having a working face 51. The tip is used to force molten metal into the die cavity, the molten metal being forced through the working face 51. FIG. 5 shows a core pin 60 having an outer diameter forming a working face 61 which forms the inside diameter of a casting. FIG. 6 illustrates a nozzle 70 having a bore 71 through which the molten material for metal or plastic injection molding is fed under pressure. As such, the surface 72 forming the bore 71 is subjected to the thermal stresses imposed by the washing action of the hot material being fed through the nozzle.

The high thermal conductivity of the alloys of the present invention when used as shaping members tends to result in solid, sound castings; and the rapid rate of heat removal tends to reduce welding and erosion and thermal stresses.

The shaping members of the present invention can withstand many more cycles of operation than steel shaping members before polishing and/or machining is necessary. The shaping surface of the shaping members of the present invention almost always have a surface roughness below about $300 \times 10^{-6}$ inches after 50,000 cycles. It is usually below $300 \times 10^{-6}$ inches after 100,000 cycles and very often below $300 \times 10^{-6}$ inches after 125,000 cycles. In fact, in many instances the surface roughness is below $200 \times 10^{-6}$ inches after 50,000 cycles, and even below $200 \times 10^{-6}$ inches after 100,000 or 120,000 cycles.

We claim:

1. A shaping member containing a sintered Mo base alloy consisting essentially of about 80 wt.% or more Mo, two metallic elements forming an alloy which when molten dissolves an appreciable amount of Mo, and a property improving element, the two metallic elements forming the alloy selected from one of the following groups consisting of (a) Mn and an additional element selected from the group consisting of Ni, Fe, Cu, Ti, Zr, U, Si and Co, (b) V and an additional element selected from the group consisting of Ni, Fe, Co, Mn and Cr, (c) Si and an additional element selected from the group consisting of Ni, Fe, Co, Cu and V, (d) B and an additional element selected from the group consisting of Ni, Fe, Co, Cr, V, Nb and/or Ta, (e) Ni and an additional element selected from the group consisting of Fe, Co, Cr and Cu, and (f) Fe and Co, and the property improving element being different from the two metallic elements, the property improving element selected from the group consisting of Re, Ti, Zr, Hf, Co, Cr, Al, Cu, Ta, W, Nb, Ru, and B.

2. The shaping member of claim 1, wherein the Mn content of the elements of group (a) is about 10 to about 95 wt.%, the V content of the elements of group (b) is about 5 to about 80 wt.%, the Si content of the elements of group (c) is about 5 to about 70 wt.%, the B content of the elements of group (d) is about 1 to about 20 wt.%, the Ni content of the elements of group (e) is about 0.5 to about 10 wt.%, and the Fe content of the elements of group (f) is about 20 to about 30 wt.%, and wherein the wt.% of the property improving element is up to 10 wt.% Re, up to 5 wt.% Ti, Zr, Hf, W, Co, Cr, Cu, Al, Ta and Nb, up to 2 wt.% B and up to 1 wt.% Ru.

3. The shaping member of claim 1 wherein the alloy is liquid phase sintered.

4. The shaping member of claim 3 wherein the Mo based alloy consists essentially of Mo, Ni, Cu and a property improving element.

5. The shaping member of claim 4 wherein the ratio of Ni to Cu is about 9:1 to about 7:3 and the property improving element is selected from the group consisting of up to 10 wt.% Re, up to 5 wt.% Co, Ti, Zr, Hf, Cr, Al, W, Ta and Nb, up to 2 wt.% B, and up to 1 wt.% Ru.

6. The shaping member of claim 2 wherein the two metallic elements are selected from group (a).

7. The shaping member of claim 2 wherein the two metallic elements are selected from group (b).

8. The shaping member of claim 2 wherein the two metallic elements are selected from group (c).

9. The shaping member of claim 2 wherein the two metallic elements are selected from group (d).

10. The shaping member of claim 2 wherein the two metallic elements are selected from group (e).

11. The shaping member of claim 2 wherein the two metallic elements are selected from group (f).

12. The shaping member of claim 6 wherein the property improving element is selected from the group consisting of Re, Ru, Cr and Co.

13. The shaping member of claim 7 wherein the property improving element is selected from the group consisting of Re, Mn, Ru, Cr and Co.

14. The shaping member of claim 8 wherein the property improving element is selected from the group consisting of Re, Mn, Ru, Cr and Co.

15. The shaping member of claim 9 wherein the property improving element is selected from the group consisting of Re, Mn, Ru, Cr and Co.

16. The shaping member of claim 10 wherein the property improving element is selected from the group consisting of Re, Ru, Cr and Co.

17. The shaping member of claim 11 wherein the property improving element is selected from the group consisting of Re, Mn, Ru, Cr and Co.

* * * * *

UNITED STATES PATENT OFFICE

CERTIFICATE OF CORRECTION

PATENT NO. : 3958316

DATED : May 25, 1976

INVENTOR(S) : Earl I. Larsen and Richard H. Krock

It is certified that error appears in the above-identified patent and that said Letters Patent are hereby corrected as shown below:

Col. 1, line 50, cancel "foregoing" and insert ---forging---.

Col. 2, line 59 cancel "from" and insert ---form---.

Signed and Sealed this

Fourteenth Day of September 1976

[SEAL]

*Attest:*

RUTH C. MASON
*Attesting Officer*

C. MARSHALL DANN
*Commissioner of Patents and Trademarks*